US005904100A

United States Patent [19]

Findley et al.

[11] Patent Number: 5,904,100

[45] Date of Patent: May 18, 1999

[54] METHOD AND DEVICE TO CLEAN THREE RAIL MODEL RAILROAD TRACKS

[76] Inventors: Barry B. Findley, 4900 Randolph Rd., North Little Rock, Ark. 72116; John F. Reeves, 3601 Faulkner Rd., Little Rock, Ark. 72210

[21] Appl. No.: 08/986,445

[22] Filed: Dec. 8, 1997

[51] Int. Cl.[6] ..... B61D 15/00

[52] U.S. Cl. ..... 104/279; 105/238.2; 15/97.1; 15/54

[58] Field of Search ..... 104/279, DIG. 1, 104/53; 105/238.2; 15/97.1, 103.5, 54; 446/444, 446, 447

[56] References Cited

U.S. PATENT DOCUMENTS

| | | | |
|---|---|---|---|
| 2,475,771 | 7/1949 | Wittner | 104/279 |
| 3,103,897 | 9/1963 | Bonanno et al. | 104/279 |
| 3,789,768 | 2/1974 | Broz | 104/279 |
| 5,060,335 | 10/1991 | Webster | 15/97.1 |

*Primary Examiner*—S. Joseph Morano
*Attorney, Agent, or Firm*—Barry B. Findley

[57] ABSTRACT

A three rail Model Railroad track cleaning method and device in which a roll of cleaning tissue is unwound from a supply roll and rewound on a second roll in contact with the tracks, at a rate slower than it is travelling over the tracks, so that it has a wiping action, and can travel long distances before fresh cleaning tissue coming from the supply roll is used up.

6 Claims, 3 Drawing Sheets

METHOD AND DEVICE TO CLEAN THREE RAIL MODEL RAILROAD TRACKS

Three rail Model Railroad systems depend on an electric current delivered through the rails to operate, and will slow down as the rails become dirty, the system eventually ceasing to operate at an acceptable rate if the rails are not cleaned periodically.

Methods are known of cleaning the rails whereby a cleaning pad, or the like, usually wet with a cleaning solution, is rubbed over them by hand, but this is slow and laborious.

Other methods also are known in which a pad, or like means, saturated with a cleaning solution and weighted against the rails is moved or towed around the tracks to clean them. However, in such a system the pad, or like means, becomes increasingly dirty as it travels around the tracks, necessitating that it must itself either be frequently cleaned or replaced with a fresh pad, to efficiently clean the track. The method and device of the invention eliminate these difficulties as they make it possible to effectively clean the track by simply running the device around it, since it is continually being supplied with fresh cleaning tissue coming from the supply roll.

DETAILED DESCRIPTION OF THE INVENTION

Figure 1:
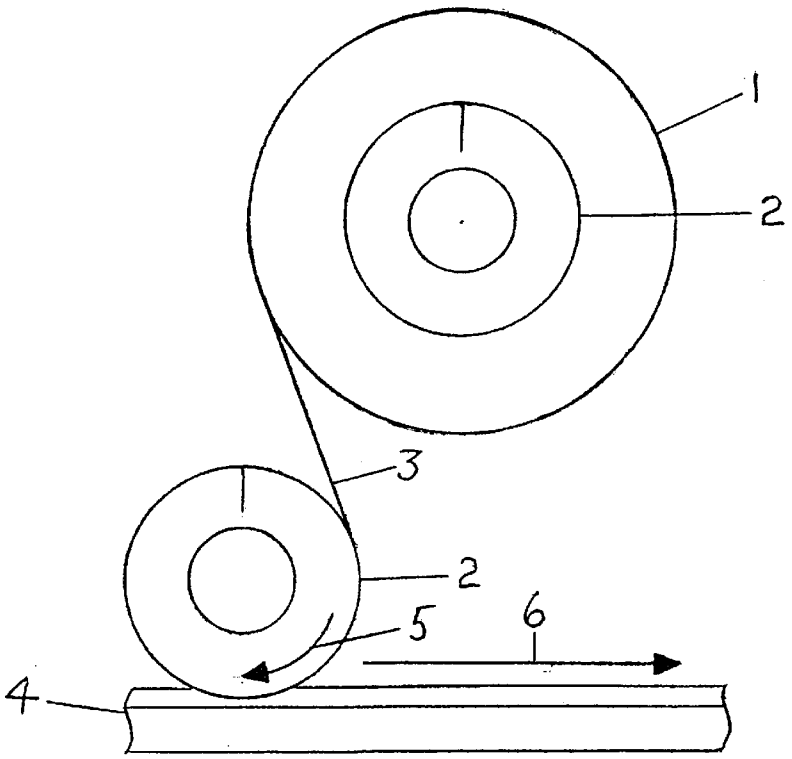
FIG. 1 is a side view how the cleaning tissue is wound and unwound to clean the track.

FIG. 1 illustrates how a supply roll of cleaning tissue 1, wound on a resilient sleeve 2, is rewound 3, on a second resilient sleeve 2, in contact with the rails 4, and at a rate slower than it is traveling on the track, as illustrated by shorter arrow 5 and longer arrow 6, so that is has a wiping action and can travel long distances before its supply of fresh cleaning tissue coming from the supply roll is exhausted.

Cleaning tissue of the type used is readily available in the market place in rolls twice the width of the rolls used in the invention, but which then may be split in two and rewound on the resilient sleeves, to provide rolls of tissue of the width required for the invention.

Material for the resilient sleeves is also readily available, such as long lengths of 2 lb./ft.cubed density closed cell polyethylene foam used as pipe covering insulation, which then may be cut to the lengths required for the invention. This material also has a slit running lengthwise in its outer surface, which provides a means of anchoring the tissue at its opposite end to the sleeves by inserting the ends into the slits. The material also is useful in that it compresses locally when under pressure against the track allowing the cleaning tissue on its surface to encompass and clean a wider upper surface of the rails.

In cases where the surface of the rails is only lightly covered with dirt, as with dust, merely running the device around the track with plain tissue is sufficient to clean it. However in cases where their surface is more heavily covered with dirt, or with grease and other contaminents, the tissue should first be saturated with a cleaning solution, such as citrus with petroleum distillate. The device may also be run around more than once, first to penetrate and loosen the dirt and grease or other contaminants, and then to mop them up.

Such citrus and petroleum distillate solutions are available for ordinary household use and are readily absorbed by the tissue on a supply roll, because of its srong wicking action, when the supply roll is placed in a cup like container and an amount of approximately two fluid ounces is poured over it.

Figure 3:
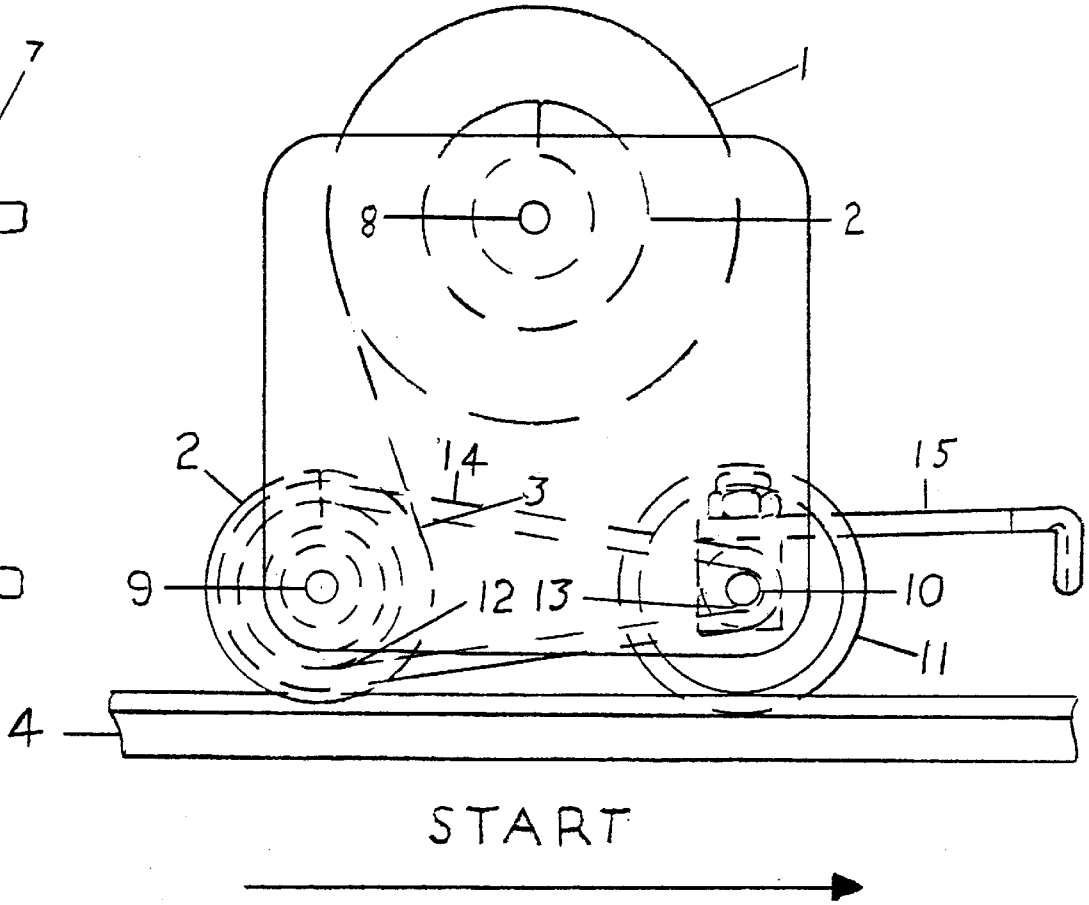
FIGS. 2 and 3 are end and side views, respectivele, of the divice of the invention with the cleaning tissue installed.
Figure 2:
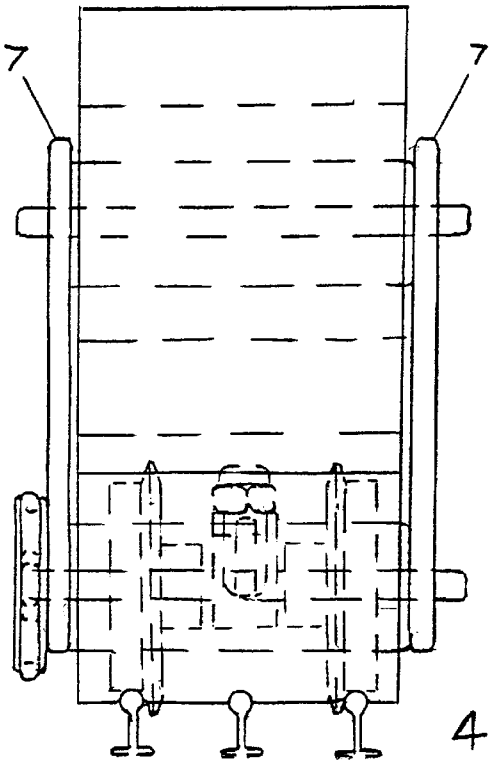

FIGS. 2 and 3 illustrates the device with the cleaning tissue of FIG. 1 installed. Plates 7 support the supply roll axle 8, which has a large diameter section included between the plates 7, the rewind axle 9, which also has a large diameter section included between the plates 7, and an axle 10, to which track wheels 11 are attached.

To install the cleaning tissue of FIG. 1 in the device, the right hand plate 7, is removed, with the axles 8, 9, and 10 remaining captive with the left hand plate 7. The cleaning tissue combination of FIG. 1 is then pushed on to the axles 8 and 9 in the position shown. The inner diameter of the sleeves 2 is slightly less then the outer diameter of the section of the axles 8 and 9 included between the plates 7, making a press fit so that the sleeves 2 will turn with the axles 8 and 9. The right hand plate 7 is then put back in place to complete the assembly. The supply roll axle 8 is left free turning but the rewind axle 9 has a large sheave 12 attached externally of the left hand plate 7, which is connected to a smaller sheave 13, attached externally of the left hand plate 7 to the axle 10, by an O-belt 14, so that as the device moves around the track, the turning of the track wheels 11, will cause a slower rate of turning of the rewind roll 3, resulting in a wiping action against the track.

O-belts made from buna-n rubber and of the length and thickness required for the invention are readily available as standard O-rings used as seals for pistons.

The tow hook 15 is swively attached at the center of the track wheels axle 10, so that it may be readily dropped down into a locked coupler at the rear of an engine, or of a train, and the device then towed around the track to clean the rails. It can also swivel sideways to accomodate towing the device around curves.

The plates 7, axles 8, 9 and 10 and track wheels 11 are made of a heavy material, such as steel, to provide sufficient weight on the rewind roll 3 so that it can wipe the rails effectively, and on the track wheels 11 so that friction with the track will ensure that they turn reliably while governing the slower rate of turning of the rewind roll 3.

Figure 5:
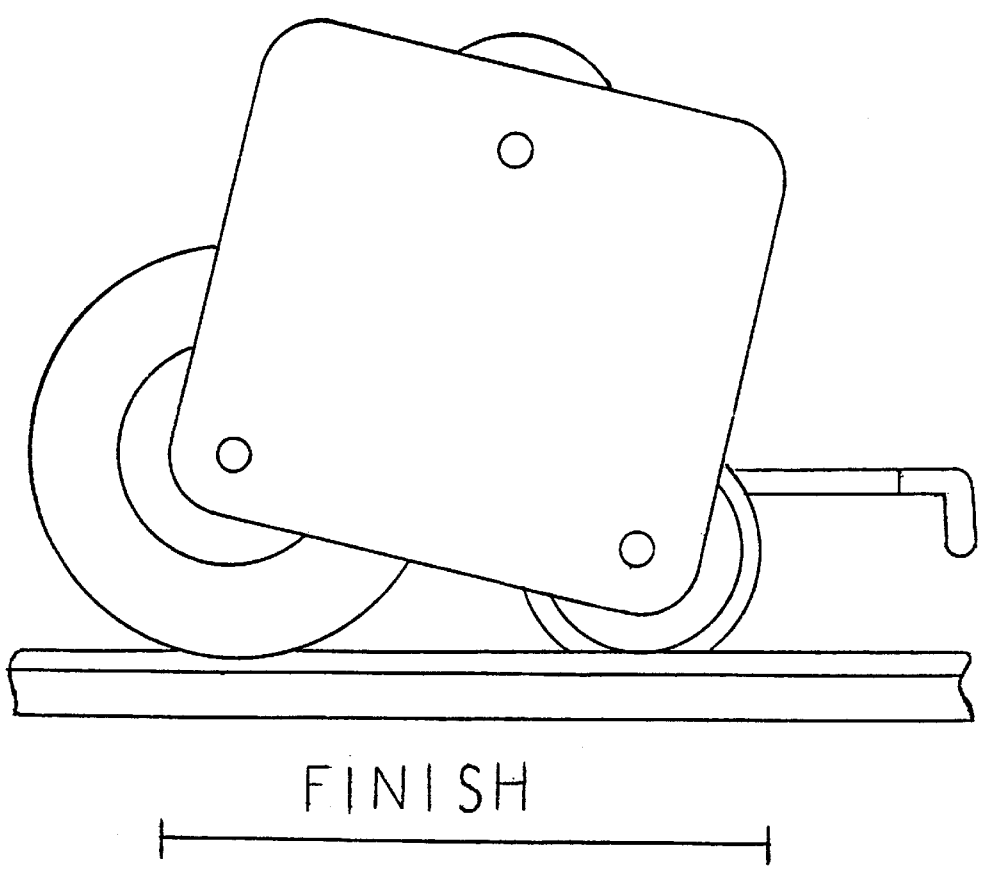
FIGS. 4–5 are end and side views, respectively, of the device of the invention after track cleaning operation has commenced.
Figure 4:
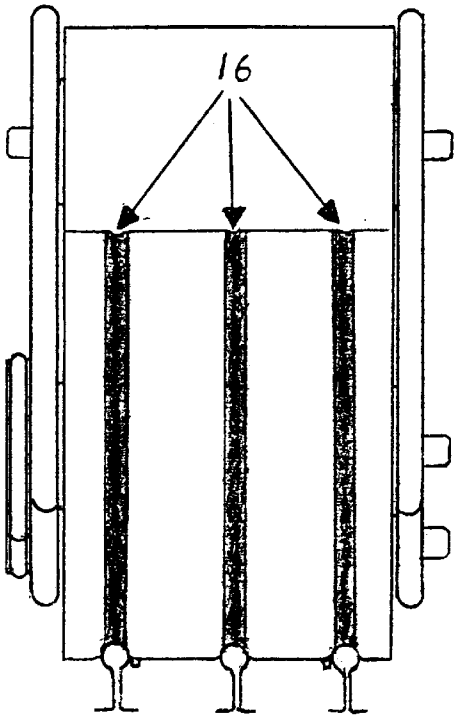

FIG. 4 and 5 illustrate the position of the device when it has used up its supply of fresh tissue on the supply roll, and the dirt 16 that has been picked up by the tissue on the rewind roll.

The device has been made compact in cross sectional outline, which enables it to travel thru tunnels and pass by other equipment placed along the track without interference. Also, the flat outside surfaces of the support plates will lend themselves to pictorial displays of animals, and of other objects of interest to children, as the device travels around the track.

We claim:

1. A model railroad track cleaning device, comprising:

a vehicle including at least one wheel for riding on the track, a supply roll of cleaning tissue mounted to a sleeve on said vehicle, and a second roll mounted on a second sleeve in contact with said track so as to wipe said track clean using said tissue, said second sleeve connected to said wheel such that said supply tissue is unwound from said supply roll onto said second roll at a rate slower than the vehicle travels over the track.

2. A model railroad track cleaning device as claimed in claim 1, wherein said first and second sleeves are made of resilient material.

3. A model railroad track cleaning device as claimed in claim 1, wherein said tissue includes a cleaning solution saturated therein.

4. A method of cleaning model railway track, comprising the steps of:

placing a vehicle having a wheel on the track, mounting a supply roll of cleaning tissue on the vehicle, mounting a second roll on the vehicle, connecting said second roll to said wheel, and moving the vehicle along the track, such that the tissue is unwound from the supply roll onto the second roll at a rate slower than the vehicle moves along the track, so as to provide a wiping action for cleaning the track.

5. A method of cleaning model railway track as claimed in claim 4, wherein:

the step of mounting the supply roll includes mounting the supply roll on a first resilient sleeve on the vehicle, the step of mounting the second roll includes mounting the second roll on a second resilient sleeve on the vehicle, and the step of connecting includes connecting said wheel to said second resilient sleeve.

6. A method of cleaning model railway track as claimed in claim 4, including the step of saturating the tissue with cleaning solution.

* * * * *